US006874247B1

(12) United States Patent
Hsu

(10) Patent No.: US 6,874,247 B1
(45) Date of Patent: Apr. 5, 2005

(54) TOOTHBRUSH DRYER

(76) Inventor: Tsang-Hung Hsu, 14 Floor, No. 632, Ta-Yu Road, Taoyuan City (TW)

( * ) Notice: Subject to any disclaimer, the term of this patent is extended or adjusted under 35 U.S.C. 154(b) by 0 days.

(21) Appl. No.: 10/962,264

(22) Filed: Oct. 12, 2004

(51) Int. Cl.[7] ..... F26B 25/00

(52) U.S. Cl. ..... 34/107; 34/202; 34/215; 34/218; 34/237; 34/239; 219/242

(58) Field of Search ..... 34/107, 202, 210, 34/215, 218, 237; 219/242, 370

(56) References Cited

U.S. PATENT DOCUMENTS 2,437,781 A * 3/1948 Hagglund ..... 206/362.1
4,493,975 A * 1/1985 Yamamoto ..... 392/384
4,759,383 A * 7/1988 Phillips ..... 134/93
4,816,648 A * 3/1989 Dusbabek ..... 219/521
4,995,511 A * 2/1991 Evans ..... 206/362.1
5,566,823 A * 10/1996 Summers ..... 206/209.1
5,852,879 A * 12/1998 Schumaier ..... 34/80
5,919,416 A * 7/1999 Auner ..... 422/26
6,171,559 B1 * 1/2001 Sanders et al. ..... 422/300
6,186,324 B1 * 2/2001 Catterson ..... 206/362.1
6,279,742 B1 * 8/2001 Immerman et al. ..... 206/362.1
6,675,492 B2 * 1/2004 Hsu ..... 34/80

* cited by examiner

*Primary Examiner*—Spephen Gravini

(57) ABSTRACT

A toothbrush dryer includes a housing formed as a heating chamber for storing toothbrush in the housing, and a heating device provided in the housing preferably at a bottom portion of the housing for warming the toothbrush for keeping a dried toothbrush for preventing bacteria, fungi or algae infection or contamination.

11 Claims, 5 Drawing Sheets

TOOTHBRUSH DRYER

BACKGROUND OF THE INVENTION

U.S. Pat. No. 5,852,879 to Daniel R. Schumaier disclosed a moisture sensitive item drying appliance for demoisturizing electronic hearing aid, tooth brush, etc., by providing a gas moving means (30) for forcing a gas flow circulation and a heater means (36) for heating the gas. However, it may increase the production or installation cost, operation and maintenance problems by providing the gas moving means (30) just for such a small appliance, thereby affecting its commercial value.

The present inventor has found the drawbacks of the prior art and invented the present toothbrush dryer with simplified mechanism and lower production cost.

SUMMARY OF THE INVENTION

The object of the present invention is to provide a toothbrush dryer including a housing formed as a heating chamber for storing toothbrush in the housing, and a heating device provided in the housing preferably at a bottom portion of the housing for warming the toothbrush for keeping a dried toothbrush for preventing bacteria, fungi or algae infection or contamination.

DETAILED DESCRIPTION

Figure 1:
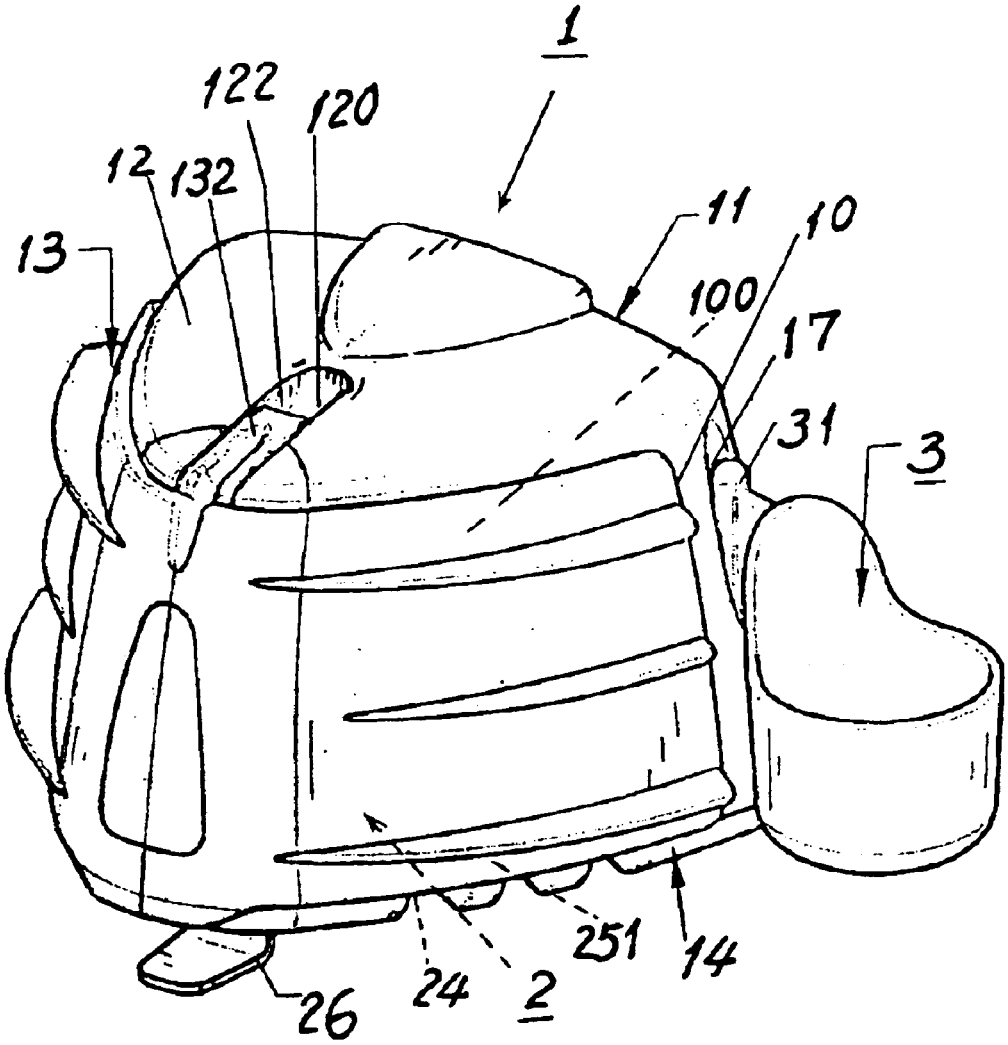
FIG. 1 is a perspective view of the present invention.
Figure 2:
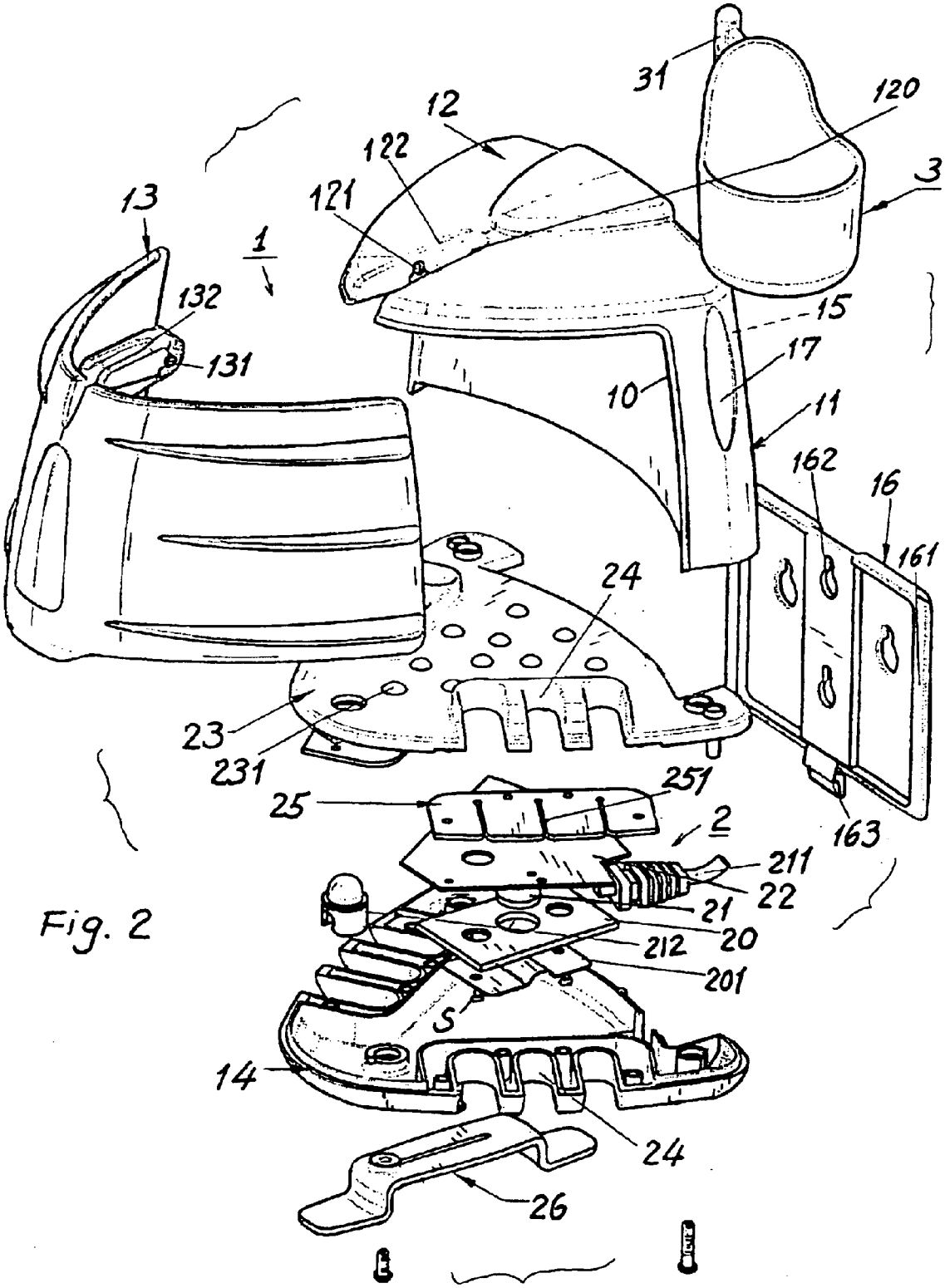
FIG. 2 is an exploded view of the present invention.
Figure 3:
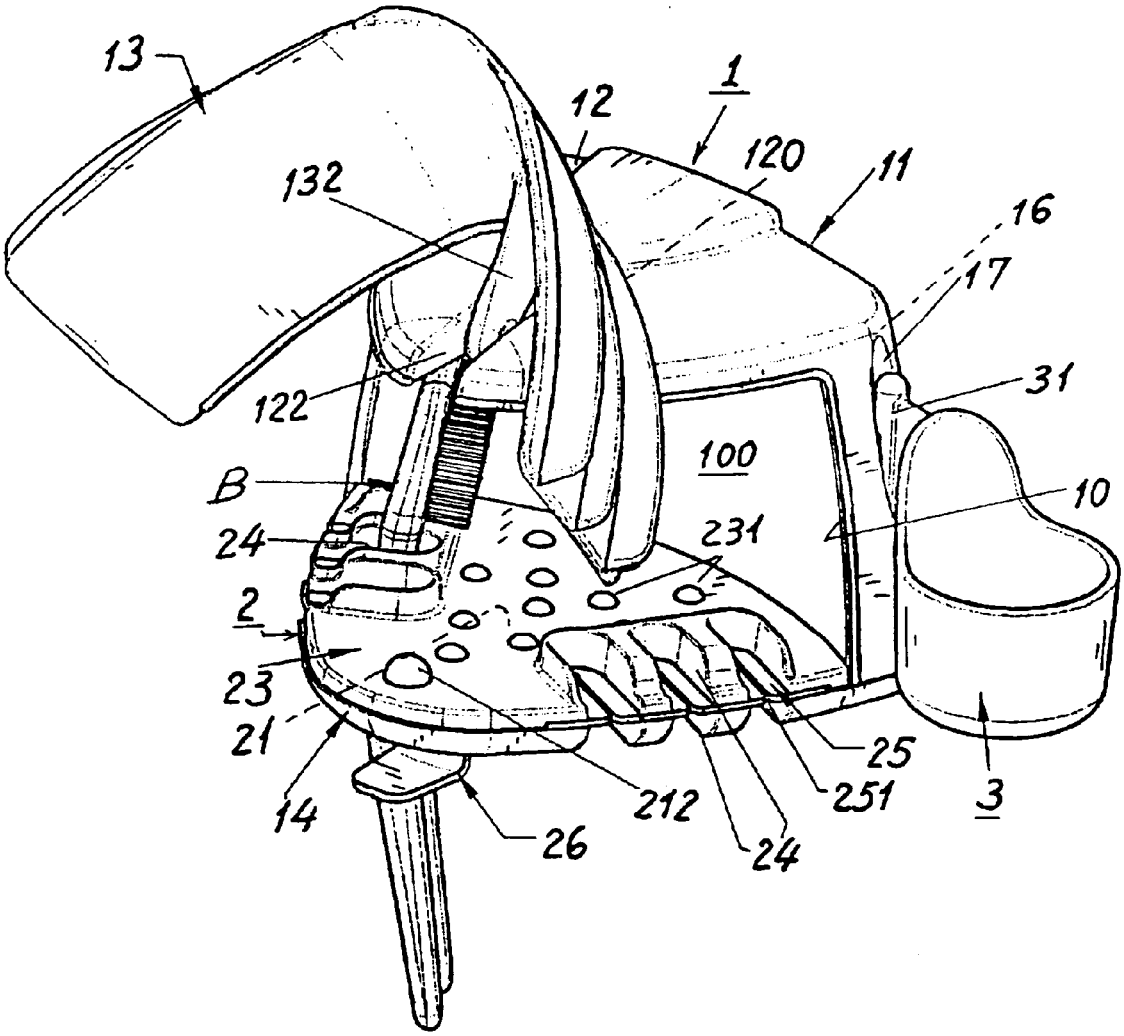
FIG. 3 is an illustration showing the present invention when opening the cover.

As shown in the drawing figures, the toothbrush dryer of the present invention comprises: a housing 1 and a heating device 2 formed or mounted in the housing 1, preferably at a bottom or lower portion of the housing 1.

The housing 1 includes: a side wall 11 generally formed as vertical wall, a top wall portion 12 secured to an upper portion of the side wall 11, a cover or front cover 13 pivotally secured to the top wall portion 12 (or pivotally secured to a housing portion of the housing 1), and a bottom wall plate 14 secured to a bottom portion of the side wall 11.

The housing 1 may be formed as a cylindrical shape or a vertical hollow column, but not limited in this invention. The housing 1 may be made of plastic or any other materials.

For hanging the present invention on a wall, a fixing plate 16 may be provided in this invention. The fixing plate 16 includes a pair of vertical extensions 161 slidably engageable with a pair of grooves 15 vertically recessed in a back portion of the side wall 11, a plurality of fixing holes 162 formed through the fixing plate 16 for fastening screws, bolts or nails through the fixing holes 162 for fixing the fixing plate 16 on a building wall (for example, a wall in a toilet room), and a retainer 163 formed on a bottom of the fixing plate 16 for downwardly limiting the side wall of the housing 1 when engaged on the fixing wall 16.

A toothpaste holder 3 may be additionally provided in the present invention, including a pin 31 formed on the toothpaste holder 3 to be inserted into a pin socket 17 recessed in the housing for detachably securing the toothpaste holder 3 on the housing 1. However, such a toothpaste holder 3 is just served as an accessory for this invention, not so critical in this invention.

The cover 13 includes: a pair of pivots 131 formed on a pivot arm 132 formed on a central upper portion of the cover to be pivotally engaged with a pair of pivot holes 121 recessed in an arm socket 122 recessed in a central front portion of the top wall portion 12 of the housing 1, whereby upon a downward pivotal movement of the cover 13, the cover 13 may close a front opening 10 formed in a front portion of the housing 1 for withdrawing toothbrush B from the housing for brushing tooth or for receiving the toothbrush B into the housing 1 for drying the toothbrush.

However, the cover of the housing 1 may be modified and designed as other choices, not limited in this invention.

The heating device 2 includes: a heating element 21 electrically connected to a power source by an electric cord 211 and secured on a board 20 which is fastened to a drying pan 23 through a heat dissipating plate 22 having a retainer plate 201 retained on a bottom of the board by screws S, and a plurality of toothbrush sockets 24 recessed in a periphery of the drying pan 23 and in the bottom wall plate 14 of the housing for holding a toothbrush B in each toothbrush socket 24.

The heating element 21 may be a heating thermistor of positive temperature coefficient semiconductor (PTCS) or any other electric heating device. The temperature as produced by the heating element 21 may be controlled to be 40–80° C., but not limited.

Each toothbrush socket 24 further includes a packing member 25 having a slit 251 cut therethrough and packed or sandwiched in between the drying pan 23 and the bottom wall plate 14 for resiliently clamping the toothbrush B as held in each toothbrush socket 24 and also for shielding the toothbrush socket 24 for precluding intrusion of external objects and water droplets thereinto.

The packing member 25 may be made of silicon rubber (but not limited) having proper heat conductivity for transferring the heat from the drying pan 23 to the toothbrush B.

The drying pan 23 is connected to the heating element 21 through the heat dissipating plate 22 which may be made of ceramic or aluminum alloy (but not limited) having good heat conductance for transferring heat from the heating element 21 to the drying pan 23 which in turn will transfer the heat towards the toothbrush for drying the toothbrush B for preventing from infection or contamination by bacteria, fungi or algae.

The drying pan 23 is preferably made of material having good heat conductance and may be made of polycarbonate (PC), but not limited in this invention.

Electric insulation should be carefully considered in selecting or making the related elements of the present invention for preventing electrical shock or injury caused to the toothbrush users whenever contacting the present invention.

The drying pan 23 has a plurality of protrusions 231 formed thereon for placing other small items including artificial teeth, razor, etc., on the pan and also for reinforcing the strength of the pan 23 and for retarding any free flow of water droplets on the pan 23 when drained onto the pan 23 such as drained from a wet toothbrush B just being inserted into the socket 24.

Figure 4:
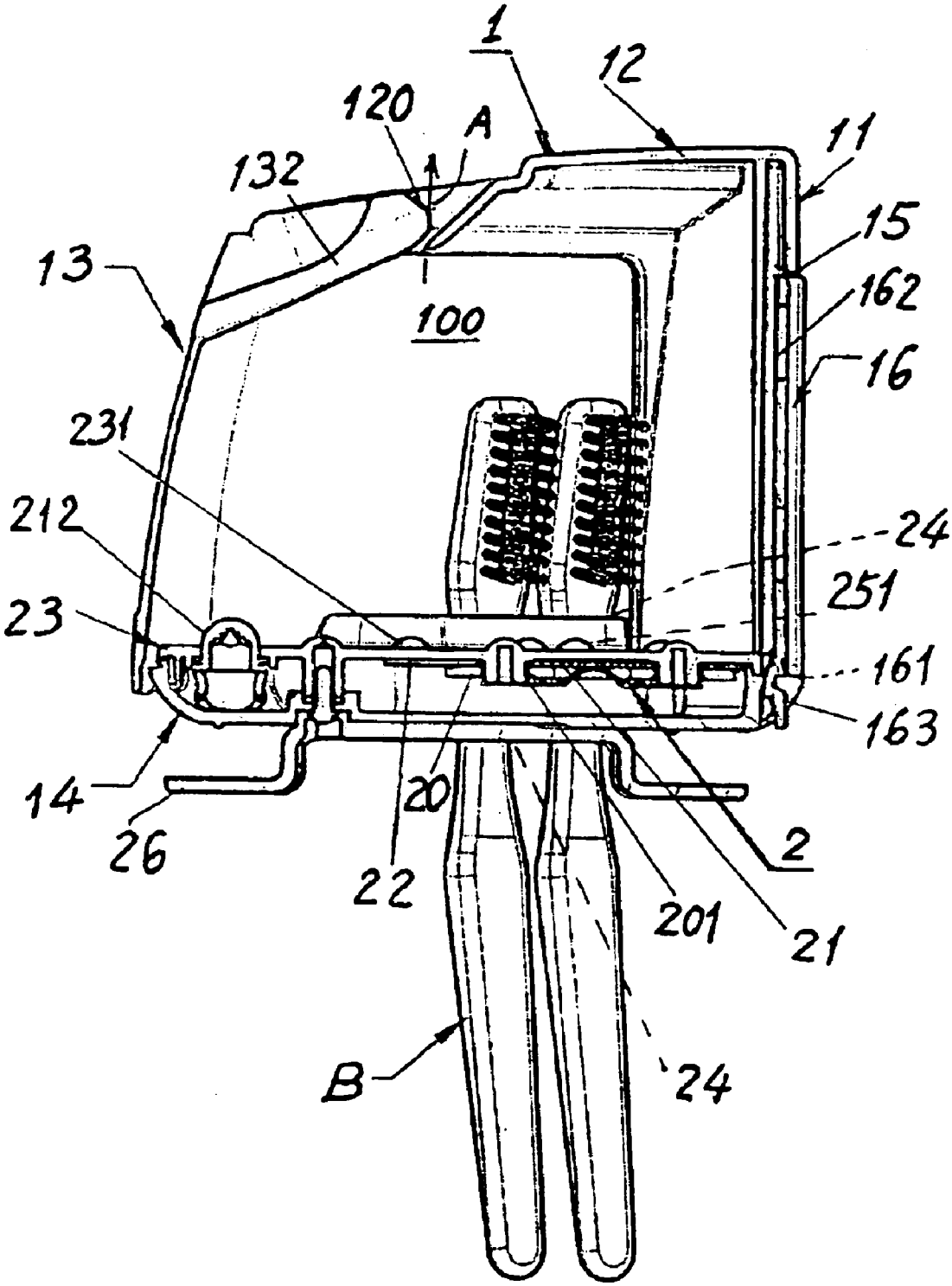
FIG. 4 is a sectional drawing of the present invention.
Figure 5:
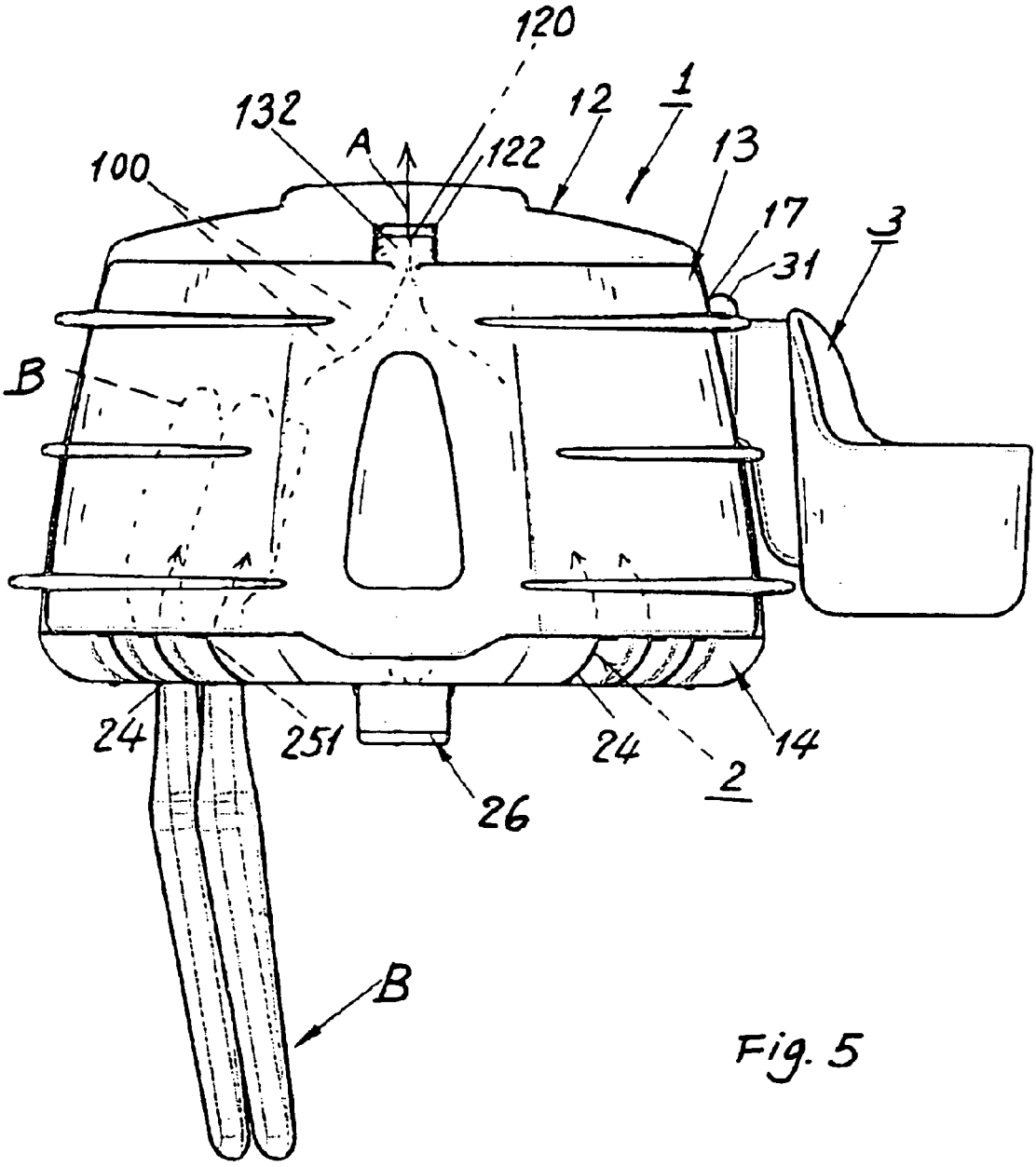
FIG. 5 shows a front view of the present invention.

Accordingly, the drying pan 23 may provide a heat source for vaporizing any water droplets drained or falling onto the pan 23 and also for heating the air entering an interior 100 in the housing 1 through the slits 251 formed in the packing members 25 in the toothbrush sockets 24 for effecting thermosiphon in the interior 100. That is to say that the air as heated will decrease its density and will be floated upwardly (A) to carry moisture or vapor from the toothbrush B as heated to be vented or discharged through a top venting hole 120 formed in the top wall portion 12 of the housing 1, to thereby release the moisture outwardly to keep a dry interior 100 in the housing 1 for preventing from bacteria, fungi or alga infection or contamination (FIGS. 4, 5).

A wire bracket 26 may be fixed under the housing 1 for winding the electrical cord 211 of the power source on the bracket 26.

A power indicator 212 may also be provided to indicate a normal power supply when operating the beating device 2 of the present invention.

The present invention is superior to the prior art because:

1. A heating element 21 is provided under the drying pan 23 to indirectly heat the toothbrush B to prevent from overheating of the toothbrush B which is generally made of plastic material.
2. A thermosiphon is effected in the interior of the housing 1 which acts like a stack for drafting an air streamflow upwardly to carry and discharge the moisture as released from the toothbrush to efficiently discharge the moisture and efficiently dry the toothbrush. An air fan for forced draft of the air is thus eliminated for saving production cost of the dryer.
3. The elements are simple so that the production cost will be decreased and the operation and maintenance problems will be minimized.

The present invention may be modified without departing from the spirit and scope of the present invention.

I claim:

1. A toothbrush dryer comprising:

a housing having a cover formed thereon for defining an interior in said housing when closing the cover, with said cover opened for inserting a toothbrush into said housing or for withdrawing a toothbrush from said housing; and a heating device formed in said housing for heating a drying pan formed in a bottom portion of said housing for transferring heat from said heating device to said toothbrush for indirectly heating the toothbrush, and for heating said drying pan for heating air in said interior for effecting a thermosiphon of the air for carrying and discharging moisture outwardly as released from the toothbrush to dry the toothbrush for preventing from bacteria infection or contamination.

2. A dryer according to claim 1, wherein said housing includes: a side wall generally formed as vertical wall, a top wall portion secured to an upper portion of the side wall, said cover pivotally secured to the top wall portion, and a bottom wall plate secured to a bottom portion of the side wall.

3. A dryer according to claim 2, wherein said housing further includes a fixing plate having a pair of vertical extensions slidably engageable with a pair of grooves vertically recessed in a back portion of the side wall, a plurality of fixing holes formed through the fixing plate for fastening screws through the fixing holes for fixing the fixing plate on a building wall, and a retainer formed on a bottom of the fixing plate for downwardly limiting the side wall of the housing when engaged on the fixing wall.

4. A dryer according to claim 1, wherein said housing includes a toothpaste holder having a pin formed on the toothpaste holder to be inserted into a pin socket recessed in the housing for detachably securing the toothpaste holder on the housing.

5. A dryer according to claim 2, wherein said cover includes: a pair of pivots formed on a pivot arm formed on a central upper portion of the cover to be pivotally engaged with a pair of pivot holes recessed in an arm socket recessed in a central front portion of the top wall portion of the housing, whereby upon a downward pivotal movement of the cover, the cover will close a front opening formed in a front portion of the housing for receiving the toothbrush into the housing.

6. A dryer according to claim 1, wherein said heating device includes: a heating element electrically connected to a power source by an electric cord and secured on a board which is fastened to said drying pan through a heat dissipating plate having a retainer plate retained on a bottom of the board, and a plurality of toothbrush sockets recessed in a periphery of the drying pan and in a bottom wall plate of said housing for holding a toothbrush in each said toothbrush socket.

7. A dryer according to claim 6, wherein said heating element is a heating thermistor of positive temperature coefficient semiconductor.

8. A dryer according to claim 6, wherein each said toothbrush socket further includes a packing member having a slit cut therethrough and packed or sandwiched in between the drying pan and the bottom wall plate for resiliently clamping the toothbrush as held in each said toothbrush socket and for shielding the toothbrush socket for precluding intrusion of external objects and water droplets thereinto.

9. A dryer according to claim 8, wherein said packing member is made of silicon rubber having a heat conductivity for transferring the heat from the drying pan to the toothbrush.

10. A dryer according to claim 6, wherein said drying pan has a plurality of protrusions formed thereon.

11. A dryer according to claim 1, wherein said housing further includes a wire bracket fixed under the housing for winding an electrical cord of the power source of the heating device on the bracket.

* * * * *